US006997024B2

(12) United States Patent
Etlicher

(10) Patent No.: US 6,997,024 B2
(45) Date of Patent: Feb. 14, 2006

(54) PULL DOOR LOCK

(75) Inventor: Peter Etlicher, Rice Lake, WI (US)

(73) Assignee: Truth Hardware Corporation, Owatonna, MN (US)

( * ) Notice: Subject to any disclaimer, the term of this patent is extended or adjusted under 35 U.S.C. 154(b) by 0 days.

(21) Appl. No.: 10/677,089

(22) Filed: Oct. 1, 2003

(65) Prior Publication Data

US 2005/0073157 A1 Apr. 7, 2005

(51) Int. Cl.
*E05B 1/00* (2006.01)

(52) U.S. Cl. ..... 70/210; 70/224; 292/336.3; 292/336.5

(58) Field of Classification Search ..... 292/336.3, 292/336.5, 352–353, 347–348, 350, 357, 292/DIG. 30, 210, 224, 467, 471, 483–485; 70/215–217, 210, 224, 467, 471, 483–485
See application file for complete search history.

(56) References Cited

U.S. PATENT DOCUMENTS 1,247,532 A * 11/1917 Heath ..... 702/215
1,787,707 A * 1/1931 Sullivan ..... 292/357
3,955,839 A 5/1976 Praska et al.
4,169,618 A * 10/1979 Potter et al. ..... 292/336.5
4,380,915 A * 4/1983 Kincaid et al. ..... 70/215
4,565,080 A * 1/1986 Kincaid et al. ..... 70/215
D297,911 S 10/1988 Rubin
4,991,414 A * 2/1991 Moore et al. ..... 70/215
5,286,074 A * 2/1994 Lin ..... 292/357
5,390,517 A * 2/1995 Yamada ..... 70/224
5,582,442 A 12/1996 Nolte
5,664,448 A * 9/1997 Swan et al. ..... 70/224
6,029,484 A * 2/2000 Jetton ..... 292/357
6,036,243 A 3/2000 Blom
6,178,789 B1 * 1/2001 Finkelstein et al. ..... 70/224
6,179,352 B1 * 1/2001 Schneeberger ..... 292/347
6,322,113 B1 11/2001 Ayers et al.
D451,360 S 12/2001 Nesseth
6,412,318 B1 * 7/2002 Shen ..... 70/217
6,494,509 B2 * 12/2002 Molzer ..... 292/336.3
6,532,629 B2 * 3/2003 Armstrong ..... 292/348
6,546,765 B1 * 4/2003 Linares ..... 292/336.3
6,655,108 B2 12/2003 Larson et al.
6,769,278 B1 * 8/2004 Chang ..... 292/350
6,857,300 B1 * 2/2005 Heeley et al. ..... 70/210

FOREIGN PATENT DOCUMENTS

GB 2262770 A * 6/1993

* cited by examiner

*Primary Examiner*—Brian E. Glessner
*Assistant Examiner*—Christopher Boswell
(74) *Attorney, Agent, or Firm*—Merchant & Gould, P.C.

(57) ABSTRACT

The present invention relates to locking door latches. A door latch according to the invention may include a handle assembly that includes a generally cylindrical shank having an axis, an engagement member that includes a generally cylindrical bore configured to permit the shank to pass through the engagement member, a spindle operable by the shank, and a live bolt assembly coupled to the spindle so as to be actuated by the spindle. The handle is movable in a direction parallel to the axis between a first position and a second position. In the first position, the shank engages the engagement member so as to prohibit the shank from rotating about the axis. In the second position, the shank does not engage the engagement member so as to permit rotation of the shank about the axis.

22 Claims, 6 Drawing Sheets

PULL DOOR LOCK

BACKGROUND OF THE INVENTION

1. Field of the Invention

The present invention generally relates to locking mechanisms, and more specifically relates to locking latches for a door.

2. Related Art

Doors may be locked in a variety of ways, for example, using a dead bolt lock or a locking handle that prohibits the handle and a live bolt actuated by the handle from moving. Dead bolts are typically actuated with a key or thumb turn on an interior side of the door, and are actuated with a key or are inaccessible on an exterior side of the door. A locking handle typically includes a locking mechanism built into the handle, such as a key cylinder, push button lock, or thumb turn lock that prevents the handle and the live bolt from moving. One locking handle design that is typically used for interior doors is a generally cylindrical shaped handle that pushes in and twists into a locked position, and then must be pushed in and twisted in the reverse direction to unlock the handle.

Known locking handle designs are often complex and require many parts that may be difficult to assembly and costly to manufacture. Further, known locking handle designs are often cumbersome to use and can become difficult to actuate after prolonged use. Also, with some locking handle designs it may be unclear whether the handle is in a locked position because the handle may be able to rotate when in the locked position, or the locking mechanism does not visually appear to be locked when in a locked position.

SUMMARY OF THE INVENTION

One aspect of the present invention relates to a latch assembly that includes an engagement member having an aperture, and a locking member such as a locking handle having an axis. A portion of the locking member extends through the aperture in a direction parallel to the axis, and is movable axially between a first position and a second position relative to the engagement member in the direction parallel to the axis. In the first position, the locking member engages the engagement member so as to prohibit rotation of the handle. In the second position, the locking member is free to rotate relative to the engagement member. Such a latch assembly may be suited for use with a storm door or other type of door.

Another aspect of the present invention relates to a handle assembly that includes a generally cylindrical shank having an axis, an engagement member that includes a generally cylindrical bore configured to permit the shank to pass through the engagement member, a spindle operable by the shank, and a live bolt assembly coupled to the spindle so as to be actuated by the spindle. The handle is movable axially in a direction parallel to the axis between a first position and a second position. In the first position, the shank engages the engagement member so as to prohibit the shank from rotating about the axis. In the second position, the shank does not engage the engagement member so as to permit rotation of the shank about the axis.

A further aspect of the invention relates to a method of locking a latch assembly that includes an engagement member having an aperture and a locking member having an axis. A portion of the locking member extends through the aperture in a direction parallel to the axis, and the locking member is movable in a direction parallel to the axis and is rotatable about the axis. The method may include moving the locking member into a first position relative to the engagement member in the direction parallel to the axis so that the locking member engages the engagement member to prohibit rotation of the locking member about the axis. The method may also include moving the locking member into a second position relative to the engagement member in the direction parallel to the axis so that the locking member is free to rotate about the axis.

A yet further aspect of the invention may relate to a handle having a first portion that has an axis, and a second portion secured to the first portion and extending in a generally perpendicular direction relative to the axis. The handle is configured to engage an engagement member and is movable in a direction parallel to the axis to lock and unlock the handle relative to the engagement member without rotating the handle about the axis.

These features of novelty and various other advantages that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

Referring now to the drawings, wherein like reference numerals and letters indicate corresponding structure throughout the several views.

DETAILED DESCRIPTION OF THE PREFERRED EMBODIMENT

The present invention generally relates to a pull-type latch assembly. The latch assembly includes an engagement member such as a mounting plate that includes an aperture, and a locking member such as a locking handle that extends through the aperture to contact the engagement member. The latch assembly may be locked using a pull type motion. Pulling the locking member out relative to the aperture of the engagement member moves the locking member from an unlocked to a locked position, and pushing the locking member into the aperture has the reverse effect. In some embodiments, the engagement member is an escutcheon plate and the latch assembly controls actuation of a live bolt. Although the latch assembly is preferably used with a storm door, it may be used on other types of interior and exterior doors, windows or other structures that require a locking mechanism.

Figure 1:
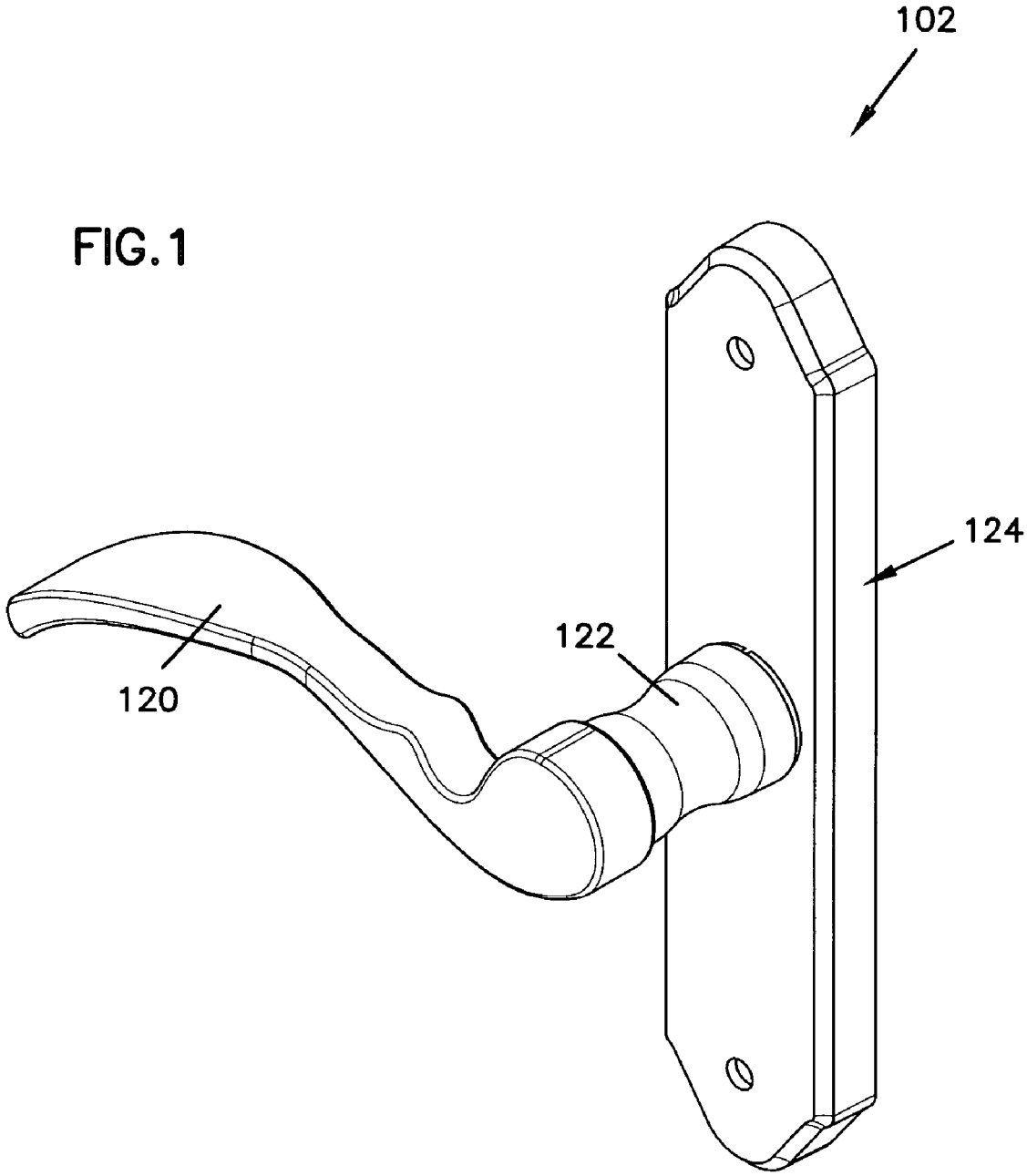
FIG. 1 is a front perspective view of a locking handle assembly according to principles of the present invention.

One example of a latch according to principles of the invention is shown as first handle assembly 102 in FIG. 1. Assembly 102 includes a handle portion 120, a shank portion 122 and an escutcheon plate 124. The shank 122 is inserted into a bore (not shown) formed in escutcheon plate 124. By axially moving the shank 122 (to which handle 120 is secured) in and out of the bore formed in the escutcheon plate 124, assembly 102 is placed into locked or unlocked positions, as will be discussed in more detail below. Actuating the assembly 102 into locked and unlocked positions is possible without rotating handle 120 about an axis parallel to an axis of the escutcheon plate bore.

Figure 2:
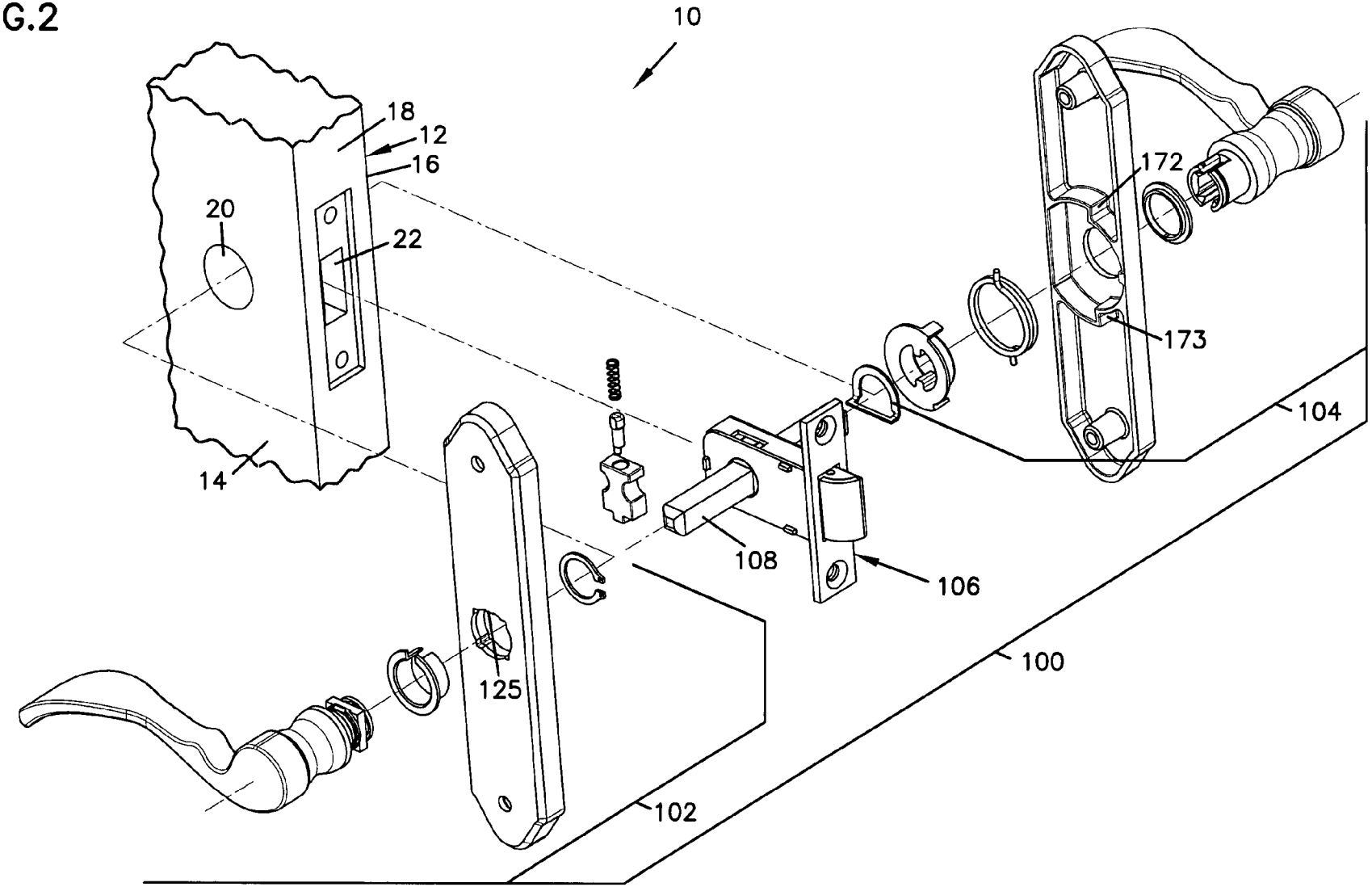
FIG. 2 is a front exploded perspective view of a storm door assembly including a latch assembly according to principles of the present invention.

First handle assembly 102 may be part of a greater storm door assembly 10 as shown in FIG. 2. Assembly 10 includes a door 12 and a latch assembly 100 that includes first handle assembly 102, a second handle assembly 104, a live bolt assembly 106 and a spindle 108.

Door 12 includes first and second opposing primary surfaces 14, 16, an edge surface 18, a first bore 20 that extends between the first and second surfaces 14, 16, and a second bore 22 formed in edge surface 18. When the latch assembly 100 is mounted to door 12, first assembly 102 is mounted to the first primary surface 14, the second assembly 104 is mounted to the second primary surface 16, and the live bolt assembly 106 is mounted in second bore 22 on edge surface 18. Spindle 108 passes through first bore 20 and is coupled to the first and second handle assemblies 102, 104 and the live bolt assembly 106. When mounted to door 12, latch assembly 100 is configured such that the live bolt assembly 106 may be actuated by either the first or second handle assemblies 102, 104.

Figure 3:
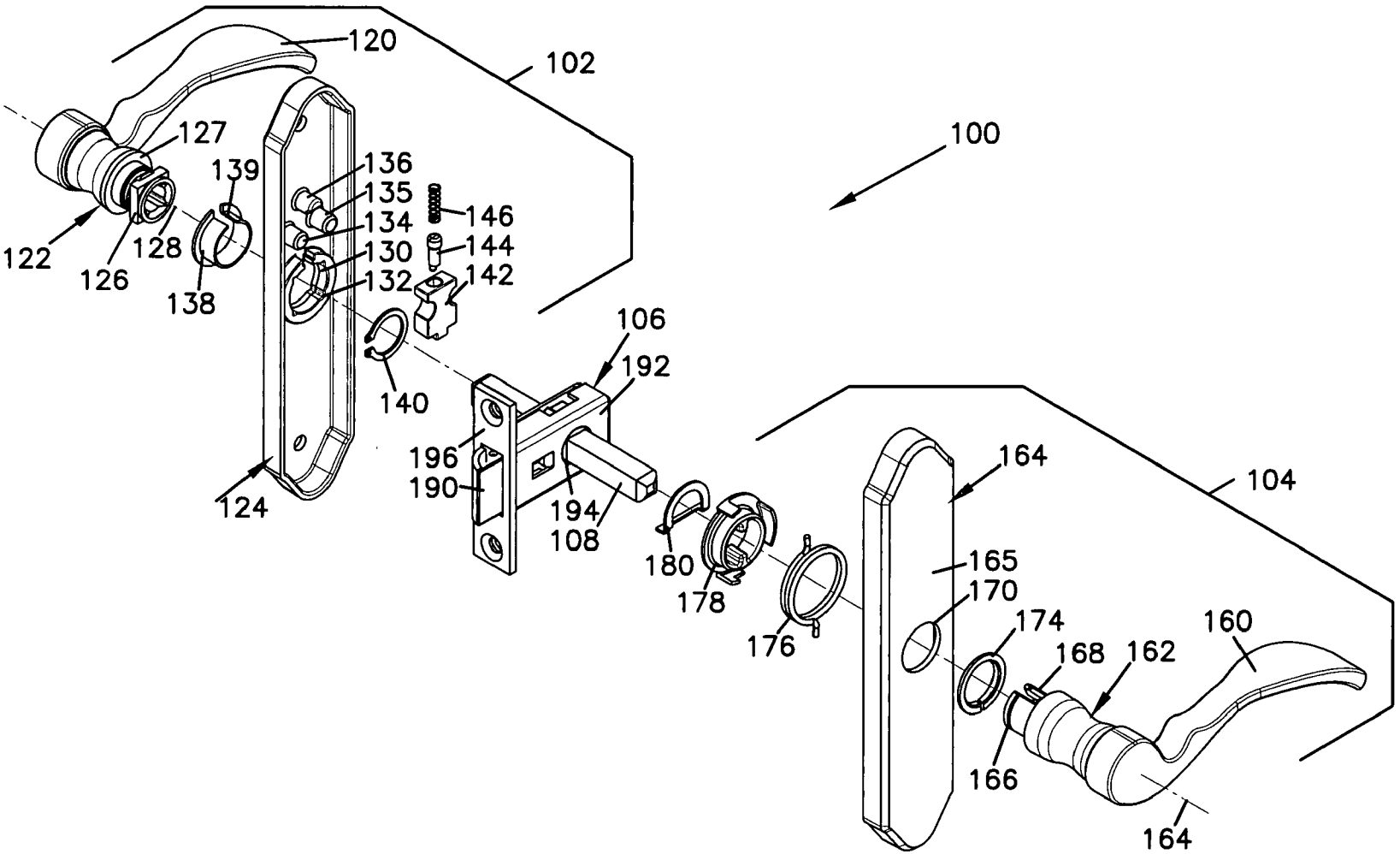
FIG. 3 is a rear exploded perspective view of the latch assembly shown in FIG. 2.

Features of latch assembly 100 are discussed in further detail with reference to the additional exploded view shown in the FIG. 3. The shank 122 of first handle assembly 102 includes a locking structure 126, an axis 128, and several grooves that are shown in further detail in FIGS. 5 and 6. Escutcheon plate 124 includes a bore 130 sized to receive a portion of shank 122, notches 132 formed in bore 130, and retaining structures 134, 135, 136. Assembly 102 further includes a T-bushing 138, a C-clip 140, a pin carrier 142, a pin 144, and a biasing member 146. Bushing 138 is preferably an extended T-bushing (although other suitable structures may be used) and is positioned between the locking structure 126 and a shoulder 127 of shank 122. C-clip 140 is sized to engage a groove (see FIGS. 5 and 6) at an end of shank 122 adjacent to blocking structure 126 after shank 122 has been inserted through aperature 130 so as to retain the shank 122 in plate 124. Other types of clips, such as a D-clip or another similarly functioning retaining structure may be used in place of C-clip 140. Pin 144 and biasing member 146 may be housed within pin carrier 142 such that the biasing member 146 engages retaining structure 136 and pin carrier 142 is retained in a mounted position between retaining structures 134, 135. When assembly 102 is assembled together, the pin 144 extends through pin carrier 142 and a slot 139 formed in T-bushing 138 so as to engage grooves (see FIGS. 5 and 6) in shank 122 between shoulder 127 and locking structure 126. Pin 144 provides a positive lock for shank 122, thereby defining first and second axial positions of shank 122 relative to escutcheon plate 124.

The shank 162 of second handle assembly 104 includes an axis 164, a groove 166 formed at an end of the shank, and a slot 168 also formed in the end of shank 162. Escutcheon plate 164 includes a bore 170 and first and second position stops 172, 173 (see FIG. 2). Second assembly 104 further includes a bushing 174 (preferably a T-bushing in this example), a torsion spring 176, a spring retainer 178 and a D-clip 180. Bushing 174 is intended to be positioned adjacent to an outer surface 165 of escutcheon plate 164 between plate 164 and shank 162. Torsion spring 176 is retained within spring retainer 178, which in turn is mounted to escutcheon plate 164 so that ends of the torsion spring 176 engage position stops 172, 173 when mounted to escutcheon plate 164. Groove 168 of shank 162 engages features of spring retainer 178 when assembly 104 is assembled together. D-clip 180 engages slot 166 to retain the assembled second assembly 104 together. Other types of clips, such as a C-clip or similarly functioning retaining structure may be used in place of D-clip 180.

Live bolt assembly 106 includes a live bolt 190, a live bolt housing 192, a bore 194 formed in the live bolt housing 192, and a face plate 196. When latch assembly 100 is mounted to a door, spindle 108 is coupled within bore 194 of the latch assembly 106, shank 122 of first handle assembly 102, and shank 162 of second latch assembly 104. When first handle assembly 102 is in an unlocked position, either of handles 120, 160 may be used to rotate spindle 108, thereby actuating live bolt 190 in and out of live bolt housing 192. Torsion spring 176 is functional to bias handles 120, 160 into a horizontal rest position. Latch assembly 100 may be configured such that handles 120, 160 may rotate in only the downward position, or may be configured to rotate in either the up or downward rotated directions to actuate live bolt 190.

When first handle assembly 102 is in a locked position, spindle 108 is immovable, thereby also locking second handle assembly 104 and live bolt 190 from moving by handles 120, 160. When first handle 102 is in an unlocked position, either the first or the second handle assembly 102, 104 may be used to actuate live bolt 190.

Figure 4:
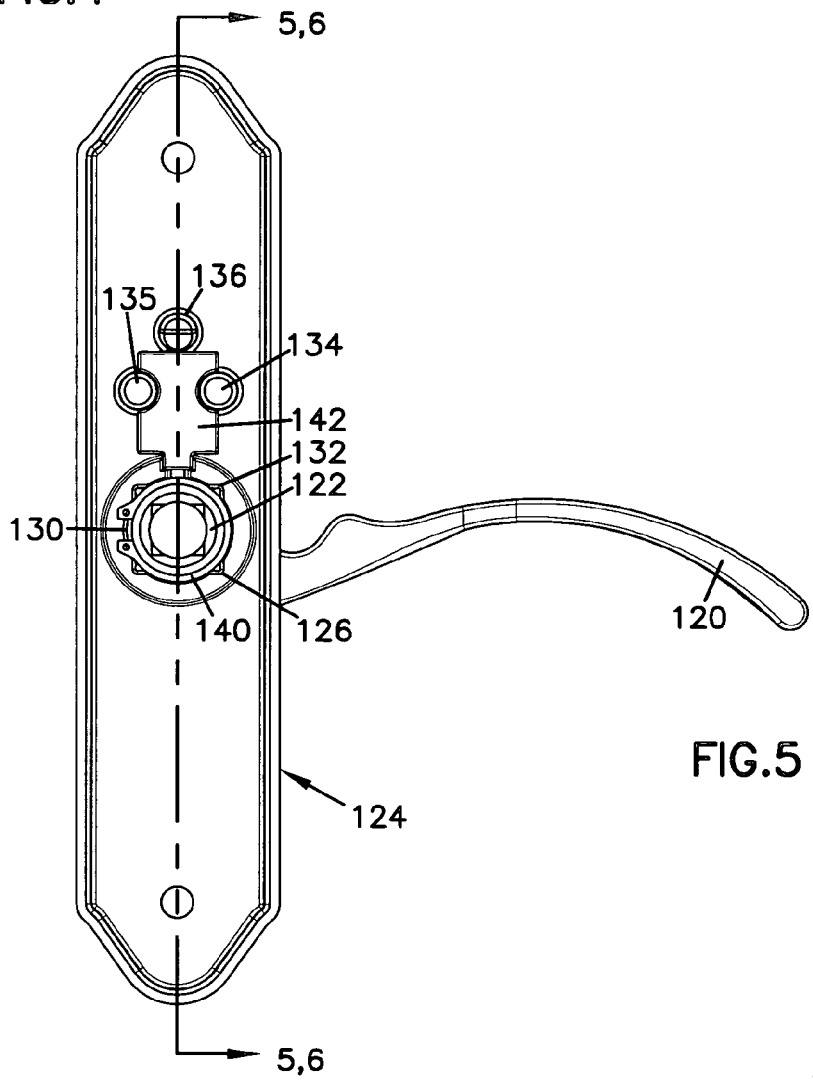
FIG. 4 is a rear plan view of the locking handle assembly shown in FIG.
Figure 5:
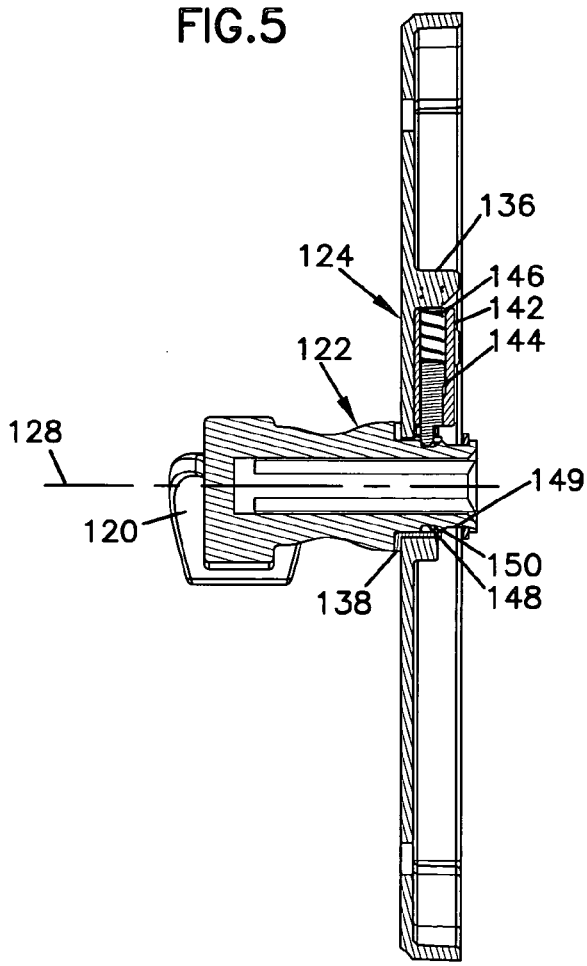
FIG. 5 is a cross-sectional view of the locking handle assembly shown in FIG. 4 with the handle in an unlocked position.
Figure 6:
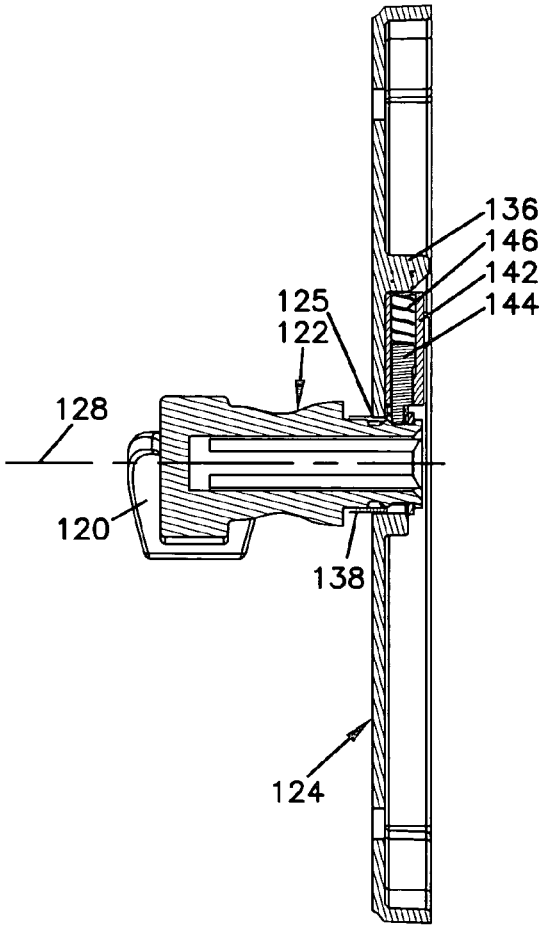
FIG. 6 is a cross-sectional view of the locking handle assembly shown in FIG. 4 with the handle in a locked position.

First handle assembly 102 is shown in further detail in the rear plan view of FIG. 4 and the cross-sectional views of FIGS. 5 and 6. FIG. 4 illustrates pin carrier 142 mounted to escutcheon plate 124 and retained in place by retaining members 134, 135, 136. FIG. 4 also illustrates the alignment of blocking structure 126 in notches 132 of bore 130.

FIG. 5 shows shank 122 in an unlocked position. Shank 122 includes first and second grooves 148, 149 that are separated by a raised lip 150. In an unlocked position, pin 144 engages first groove 148, and locking structure 126 (see FIGS. 2 and 4) does not engage the notches 132 of escutcheon plate 124. In the unlocked position shown in FIG. 5, handle 120 may be actuated to rotate shank 122 about axis 128, thereby actuating a spindle that is coupled to a live bolt assembly. By moving shank 122 in a direction along the axis 128 away from escutcheon plate 124 (direction X) pin 144 is moved upward against the bias forces of biasing member 142 to move over raised lip 150, thereby moving into second groove 149 so that locking structure 126 engages notches 132 (see FIG. 6). As a result of this arrangement of grooves, locking structures, and biased pins, first handle assembly 102 can be actuated between an unlocked position (see FIG. 5) and a locked position (see FIG. 6) by merely moving shank 122 in a direction along axis 128, which movement can be performed without rotating shank 122 about axis 128. Further, biased pin 144 provides a positive lock feel for the handle assembly 102 because a minimum amount of force is required to move the pin between the first and second grooves 148, 149, which makes the handle "feel" as if it is in a fixed axial position when in either the locked or unlocked position.

Because pin 144 must pass through slot 139 of T-bushing 138 in order to enter grooves 148, 149, bushing 138 must be retained in a fixed rotated position on shank 122. Escutcheon plate 124 may include a tab feature 125 (see FIGS. 2 and 6) that engages a portion of slot 139 of T-bushing 138 to prevent T-bushing 138 from rotating in bore 130. In other embodiments, T-bushing 138 may be secured to shank 122 in a fixed position such as, for example, using an adhesive, welding, or a snap fit or interference fit connection.

In other embodiments, locking structure 126 may be formed in the escutcheon plate and the shank 122 may include specifically designed grooves or other features to engage the locking structure of the escutcheon plate when shank 122 is in certain axial positions relative to the escutcheon plate 124. In general, there may be a variety of different configurations possible to provide at least a locked position and an unlocked position for a handle assembly whereby the locking and unlocking of the assembly can be done without rotating the handle relative to the escutcheon plate.

In a yet further embodiment, the locking structure and notches discussed above may be formed in a live bolt housing, the door itself, or other engagement structures, such as an escutcheon plate mounted on an opposing side of the door from where the handle assembly is mounted.

Figure 7:
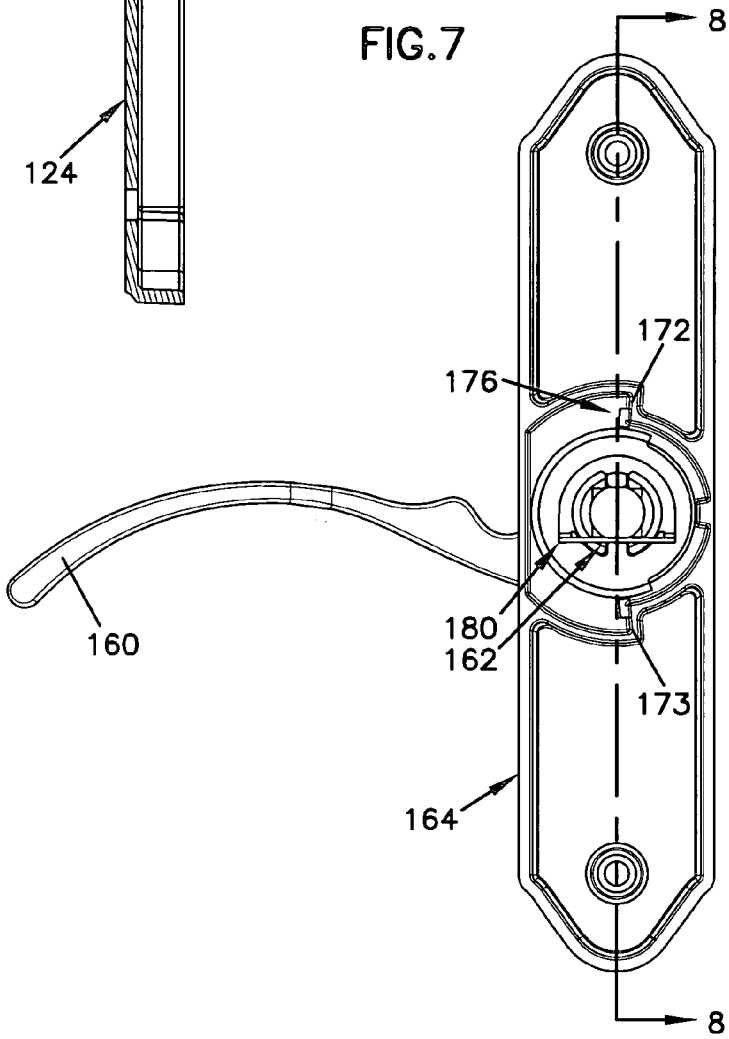
FIG. 7 is a rear plan view of the non-locking handle assembly shown in FIGS. 2 and 3.
Figure 8:
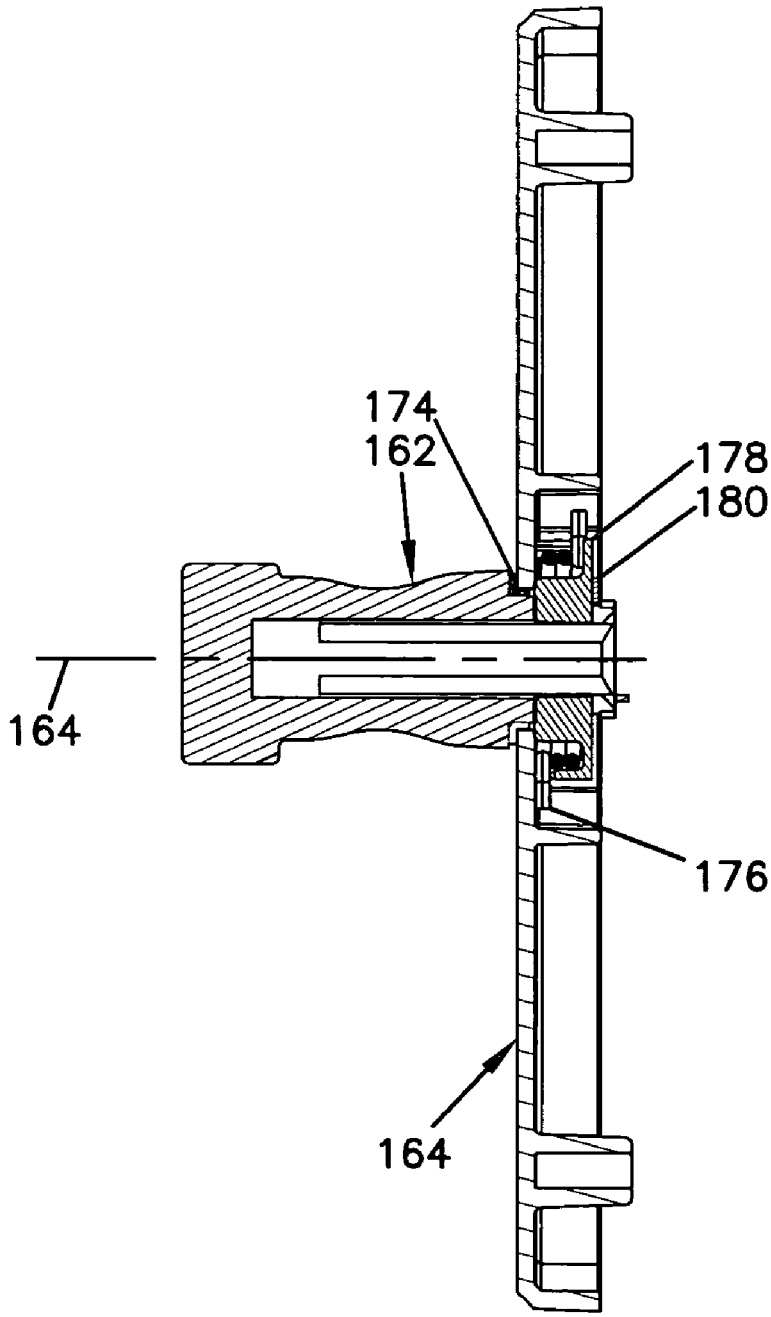
FIG. 8 is a cross-sectional view of the non-locking handle assembly shown in FIG. 7.

FIG. 7 illustrates a rear plan view of second handle assembly 104 in which spring 176 and spring retainer 178 are captured within escutcheon plate 164 such that ends of spring 176 engage stops 172, 173. The cross-sectional view of FIG. 8 further illustrates shank 162 secured to escutcheon plate 164 using D-clip 180 and having bushing 174 positioned between shank 162 and escutcheon plate 164. Rotation of shank 162 about axis 164 loads spring 176 causing a torsional force that biases shank 162 into a rest position with handle (see FIG. 7) in a generally horizontal position. Because first and second handle assemblies 102, 104 are coupled together with spindle 108, the biasing forces of torsional spring 176 also function to bias handle 120 and shank 122 of first handle assembly 102 into a predetermined rest position with handle 120 extending in a generally horizontal direction (see FIG. 4). Typically, second handle assembly is configured for use on an exterior side of a door or other structure that is to be locked and first handle assembly 102 is configured for use on an interior side of a door or other structure that is to be locked. Consequently, first handle assembly 102 is movable in a direction parallel to axis of 128 between locked and unlocked positions, and second handle assembly 104 maintains a fixed position along a direction parallel to axis 164 so that it is subject to being locked or unlocked based on the locked and unlocked positions of first handle assembly 102. However, in some embodiments, both the first and second handle assemblies 102, 104 may include the locking features of first handle assembly 102 described above.

The shank and handle features described above may be formed as a single, monolithic piece using, for example, a casting process, or may be separately formed pieces that are later secured together to create a handle assembly.

A method of locking a latch assembly according to principles of the present invention may relate to a latch assembly that includes an engagement member having an aperture and a locking member, the locking member having an axis. A portion of the locking member extends through the aperture in a direction parallel to the axis, and the locking member is movable in the direction parallel to the axis and rotatable about the axis. The method may include moving the locking member into a first position relative to the engagement member in the direction parallel to the axis so that the locking member engages the engagement member to prohibit rotation of the locking member about the axis. The method may also include moving the locking member into a second position relative to the engagement member in the direction parallel to the axis so that the locking member is free to rotate about the axis.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

I claim:

1. A latch assembly, comprising:

an engagement member having an aperture formed therein; and a locking member having an axis, a first portion of the locking member configured to extend through the aperture in a direction parallel to the axis, the locking member being movable axially between a first position wherein the locking member engages the engagement member so as to restrict rotation of the locking member about the axis, and a second position wherein the locking member is free to rotate about the axis relative to the engagement member, the first portion of the locking member including a first groove formed on an end of the first portion that extends through the aperture, a positive lock member removably biased into the groove to fix the locking member in the first position and removable from the groove to define the second position wherein moving to the first position includes pulling the locking member away from the engagement member.

2. The assembly of claim 1, wherein moving to the second position includes pushing the locking member toward the engagement member.

3. The assembly of claim 1, wherein the engagement member is an escutcheon plate.

4. The assembly of claim 1, wherein the first groove extends around a circumference of the first locking portion, and the positive lock member slides within the groove when the locking member rotates about the axis.

5. The assembly of claim 1, wherein the first portion of the locking member includes a retaining groove formed on an end thereof that extends through the aperture, and the assembly further includes a retaining clip configured to mount to the retaining groove to retain the locking member in the aperture.

6. The assembly of claim 1, further comprising a bushing having a slot, the bushing being configured for positioning between the aperture and the locking member, wherein the slot is aligned with the first groove to provide access for the positive locking member into the first groove.

7. The assembly of claim 1, further comprising a bushing positioned between the locking member and the engagement member, and the locking member includes a locking tab that engages the bushing to prevent rotation of the bushing about the axis.

8. The assembly of claim 1, wherein the locking member includes a handle that extends in a direction perpendicular to the axis.

9. The assembly of claim 1, further comprising a live bolt assembly and a spindle coupled to the live bolt assembly and the locking member, whereby rotation of the locking member about the axis actuates the live bolt.

10. The assembly of claim 9, further comprising a handle assembly separate from the locking member, wherein the spindle is further coupled to the handle assembly.

11. The assembly of claim 1, configured for use with a storm door.

12. A handle assembly, comprising:

a generally cylindrical shank having an axis and a locking feature;

an engagement member including a generally cylindrical bore that extends through the engagement member, the bore being configured to permit the locking feature of the shank to pass through the engagement member;

a spindle operable by the shank, wherein a portion of the spindle passes through the bore; and a live bolt assembly engaged by the spindle so as to be actuated by the spindle;

wherein the shank is movable in a direction parallel to the axis between a first position wherein the locking feature of the shank engages the engagement member so as to prohibit the shank from rotating about the axis, and a second position wherein the locking feature of the shank is positioned outside of the bore and free to rotate about the axis relative to the the engagement member, wherein the movement from the second position to the first position includes pulling the shank along the axis away from the engagement member.

13. The assembly of claim 12, wherein movement from the first position to the second position includes pushing the shank along the axis towards the engagement member.

14. The assembly of claim 12, further comprising a handle secured to the shank and extending in a direction perpendicular to the axis.

15. The assembly of claim 12, wherein the engagement member is an escutcheon plate.

16. A method of locking a latch assembly, the latch assembly including a locking member and an engagement member defining an aperture sized to receive the locking member, the locking member including a shank and a locking protrusion extending radially from the shank, the locking member being rotatable relative to the engagement member about an axis extending through the aperture, the method comprising the steps of:

pulling the locking member toward the engagement member along the axis into a first position wherein the locking protrusion engages the engagement member to prohibit rotation of the locking member about the axis; and pushing the locking member away from the engagement member along the axis into a second position wherein the locking protrusion is removed from the engagement member and is free to rotate about the axis.

17. A door assembly, comprising:

a door having first and second opposed primary surfaces and a bore formed between the first and second primary surfaces; and a latch assembly mounted to the first primary surface of the door adjacent to the bore, the latch assembly comprising:

an engagement member having an aperture formed therein that extends between opposing primary surfaces of the engagement member; and a locking member having a cylindrical shank portion configured to extend through the aperture and a locking feature formed on the shank portion, the locking member being movable between a first position wherein the locking feature is positioned within the aperture and engages the engagement member so as to restrict rotation of the locking member about the axis, and a second position wherein the locking feature is positioned outside of the aperture and disengaged from the engagement member so as to provide unrestricted rotation of the locking member relative to the engagement member wherein moving from the second position to the first position includes pulling the locking member in a direction away from the engagement member and moving from the first position to the second position includes pushing the locking member in a direction towards the engagement member.

18. The assembly of claim 17, wherein the latch assembly further comprises a spindle and a live bolt assembly, the live bolt assembly and the locking member being engaged byte spindle such that rotation of the locking member about the axis actuates the live bolt assembly.

19. The assembly of claim 18, wherein the latch assembly further comprises a handle assembly mounted to the second primary surface of the door adjacent to the bore, and the locking member and the handle assembly are engaged by the spindle through the bore.

20. The assembly of claim 17, wherein the locking member further includes a handle extending in a direction perpendicular to the axis.

21. A locking handle configured to lock relative to an engagement member by pulling the handle away from the engagement member to engage a first portion of the handle with the engagement member, and unlocks relative to the engagement member by pushing the handle towards the engagement member to disengage the first portion of the handle from the engagement member, wherein the handle locks and unlocks relative to the engagement member without rotating the handle about an axis parallel to the first and second directions, wherein a positive lock member engages the handle to retain the locking handle in the locked and unlocked positions, the positive lock member being movable in a direction perpendicular to the first and second directions.

22. The handle of claim 21, wherein the handle includes a second portion secured to and extending in a generally perpendicular direction from the first portion and being rotatable about the axis.

* * * * *